United States Patent [19]

Saito et al.

[11] Patent Number: 4,958,608

[45] Date of Patent: Sep. 25, 1990

[54] IGNITION SYSTEM FOR INTERNAL COMBUSTION ENGINE

[75] Inventors: Akihiko Saito, Numazu; Hideki Yukawa, Susono, both of Japan

[73] Assignee: Kokusan Denki Company, Ltd., Numazu, Japan

[21] Appl. No.: 338,058

[22] Filed: Apr. 14, 1989

[30] Foreign Application Priority Data

Apr. 27, 1988 [JP] Japan ..... 63-57077[U]

[51] Int. Cl.[5] ..... F02P 5/155

[52] U.S. Cl. ..... 123/427; 123/146.5 D; 123/651

[58] Field of Search ..... 123/427, 609, 644, 651, 123/652, 415, 418, 611, 146.5 D

[56] References Cited

U.S. PATENT DOCUMENTS

| | | | |
|---|---|---|---|
| 3,605,713 | 9/1971 | Le Masters et al. | 123/644 |
| 3,884,208 | 5/1975 | Beuter | 123/644 |
| 3,890,944 | 6/1975 | Werner et al. | 123/427 |
| 4,100,895 | 7/1978 | Hattori et al. | 123/427 |
| 4,168,691 | 9/1979 | Sawada et al. | 123/427 X |
| 4,382,429 | 5/1983 | Enoshima et al. | 123/427 X |
| 4,651,706 | 3/1987 | Yukawa et al. | 123/427 X |

FOREIGN PATENT DOCUMENTS 10812 6/1983 Japan .

*Primary Examiner*—Tony M. Argenbright

*Attorney, Agent, or Firm*—Pearne, Gordon, McCoy & Granger

[57] ABSTRACT

An ignition system for an internal combustion engine is widely known which includes a primary current control switch circuit adapted to be turned off at an ignition position to interrupt flowing of a primary current through an ignition coil, to thereby induce a high voltage for ignition across the ignition coil. Continuation of the flow of the primary current causes an increase in power consumption and generation of heat from the ignition coil. An ignition system of the present invention utilizes charging and discharging of a control capacitor to permit control over the time for which the primary current is flowing to be accomplished with a simple structure. A discharge resistor which is arranged in parallel with the control capacitor carries out discharge of the control capacitor to interrupt the flow of the primary current when the internal combustion engine is stopped.

8 Claims, 2 Drawing Sheets

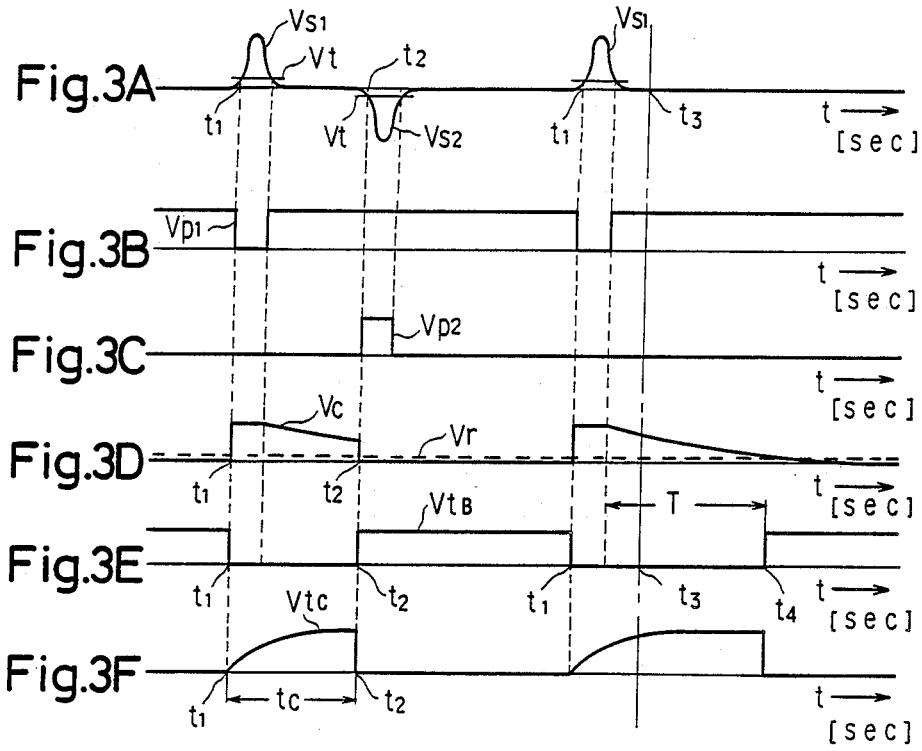
Fig.4
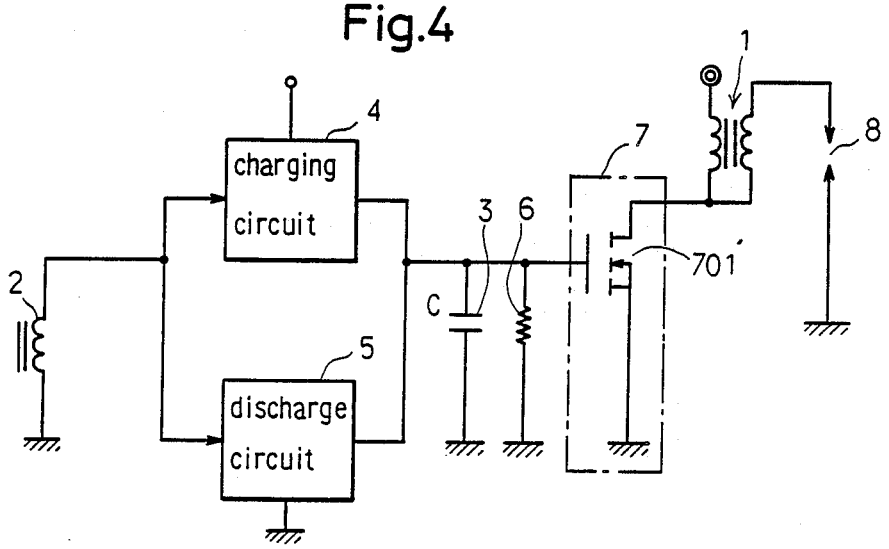

IGNITION SYSTEM FOR INTERNAL COMBUSTION ENGINE

BACKGROUND OF THE INVENTION

1. Field of the Invention

This invention relates to an ignition system for an internal combustion engine, and more particularly to an ignition system for an internal combustion engine of the current interruption type.

2. Description of the Prior Art

Such an ignition system of the current interruption type in which a battery is used for its power supply is typically disclosed in, for example, Japanese Utility Model Publication No. 10812/1963. The conventional ignition system disclosed generally includes a transistor switch which is turned off at an ignition position of an internal combustion engine and constantly turned on at an position other than the ignition position, a pulse signal generating device for generating a pulse signal at the ignition position, and a circuit for turning off the transistor switch when the pulse signal generating device generates the pulse signal.

In the conventional ignition system constructed as described above, when the transistor switch is turned off, a high voltage is induced across a primary winding of the ignition coil. The so-induced high voltage is further increased by the ignition coil, so that a high voltage for ignition may be induced across a secondary winding of the ignition coil.

In the above-described construction of the conventional ignition system, the transistor switch which functions to control the primary current of the ignition coil is turned off for a short period of time at the ignition position, however, it is turned on at any position other than the ignition position. This causes the primary current flowing through the ignition coil to lead to the generation of much heat from the ignition coil, thereby increasing power consumption. In order to solve such a problem, an ignition system is proposed which includes a time control circuit for controlling the time for which a primary current flows from a battery to an ignition coil, as disclosed in, for example, U.S. Pat. No. 3,605,713. Unfortunately, such a conventional time control circuit is highly complicated to a degree sufficient to complicate a circuit structure of the ignition system. Thus, the conventional time control circuit is not suitable for use for an ignition system in which a decrease in the number of parts is required for a reduction of its manufacturing cost.

Also, the conventional ignition system is encountered with a problem that the ignition coil is overheated when the primary current continues to flow therethrough after a stop of the internal combustion engine. In view of such a problem, an ignition system is proposed which is adapted to interrupt the flow of a primary current through an ignition coil when an internal combustion engine is stopped, as disclosed in U.S. Pat. No. 3,884,208. However, the ignition system fails to control a time for which the primary current flows.

SUMMARY OF THE INVENTION

The present invention has been made in view of the foregoing disadvantage of the prior art.

Accordingly, it is an object of the present invention to provide an ignition system for an internal combustion engine which is capable of determining a time for which a primary current if flowing through an ignition coil as desired and with a simple structure.

It is another object of the present invention to provide an ignition system for an internal combustion engine which is capable of controlling the time for which a primary current is flowing through an ignition coil and preventing the flow of the primary current through the ignition coil after the internal combustion engine has stopped.

In accordance with the present invention, an ignition system for an internal combustion engine is provided. The ignition system includes an ignition coil, a signal coil for generating a first signal at a position of which a phase is advanced relative to an ignition position of the internal combustion engine (hereinafter often referred to as "advanced position") and a second signal at the ignition position, a control capacitor, a charging circuit, a discharge circuit, a discharge resistor, and a primary current control switch circuit. The charging circuit functions to charge the control capacitor when the first signal is generated and the discharge circuit causes discharge of the control capacitor when the second signal is generated.

The charging circuit may comprise a waveform shaping circuit for generating a first pulse signal for a period of time during which the first signal exceeds a predetermined threshold level, and a charging switch circuit kept turned on to charge the control capacitor by means of a voltage of a power supply while the first pulse signal is being generated.

The discharge circuit may comprise a waveform shaping circuit for generating a second pulse signal for a period of time during which the second signal exceeds a predetermined threshold level and a discharge switch circuit driven by the second pulse signal to be turned on, instantaneously thereby instantaneously carrying out discharge of the control capacitor.

The discharge resistor is connected in parallel with the control capacitor. The primary current control switch circuit is turned on to cause a primary current to flow from the power supply to the ignition coil when a voltage across the control capacitor rises and is turned off to interrupt the primary current when the voltage falls.

In the present invention when constructed as described above, a time for which the primary current is flowing through the ignition coil can be determined by merely suitably setting a position at which the first signal is generated. Accordingly, in the present invention, determination of the time is accomplished without requiring any specific complicated circuit, resulting in the ignition system being highly simplified in its circuit structure.

Also, in the present invention, the discharge resistor is connected in parallel with the control capacitor as described above, so that discharge of the control capacitor may be carried out for a predetermined period of time when the internal combustion engine is stopped. Accordingly, even when the engine is stopped while the primary current is flowing through the ignition coil, discharge of the control capacitor takes place through the discharge resistor to automatically interrupt the primary current control switch circuit. Thus, the present invention positively prevents the primary current from continuing to flow through the ignition coil when the engine is stopped, so that overheating of the ignition coil may be effectively prevented.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference characters designate like or corresponding parts throughout; wherein:

FIGS. 3(A) to 3(F) each are a waveform chart showing a voltage waveform of each of parts in the embodiment shown in FIG. 2; and FIG. 4 is a circuit diagram showing another embodiment of an ignition system for an internal combustion engine according to the present invention.

DETAILED DESCRIPTION OF THE PREFERRED EMBODIMENTS

Now, an ignition system for an internal combustion engine according to the present invention will be described hereinafter with reference to the accompanying drawings.

Figure 1:
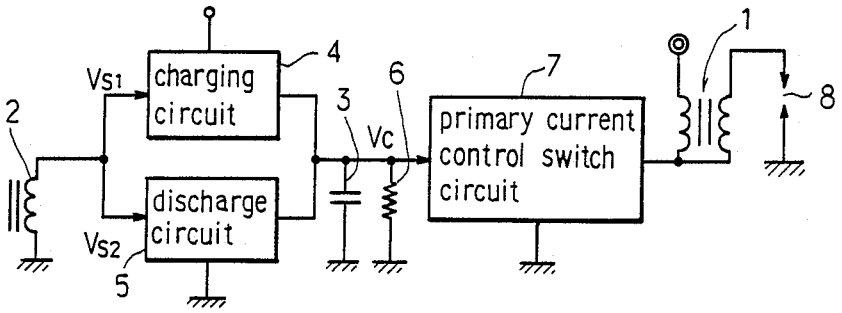
FIG. 1 is a block diagram showing a general construction of an ignition system for an internal combustion engine according to the present invention.

FIG. 1 shows a general construction of an ignition system for an internal combustion engine according to the present invention. The ignition system of the present invention generally includes an ignition coil 1 and a signal coil 2 for generating a first signal $V_{s1}$ at an advanced position or a position of which a phase is advanced relative to an ignition position at an internal combustion engine and a second signal $Vs_2$ at the ignition position of the engine, a control capacitor 3, a charging circuit 4 for charging the control capacitor 3 when the first signal is generated, a discharge circuit 5 for carrying out discharge of the control capacitor 3 when the second signal is generated, a discharge resistor 6 connected in parallel with the control capacitor 3, and a primary current control switch circuit 7.

Reference numeral 8 designates an ignition plug mounted on a cylinder of the engine and connected to a secondary winding of the ignition coil 1.

In the ignition system of the present invention generally constructed as described above, when the first signal $V_{s1}$ is generated at the advanced position, the control capacitor 3 is charged, whereas when the second signal $V_{s2}$ is generated at the ignition position, discharge of the control capacitor takes place. Accordingly, across the control capacitor 3 is induced a control voltage Vc which rises at the advanced position and falls at the ignition position. Rising of the control voltage Vc leads to the turning-on of the primary current control switch circuit 7 causing a primary current to flow from a battery or power supply to the ignition coil 1. Falling of the control voltage Vc at the ignition position causes the primary current control switch circuit 7 to interrupt the primary current, so that a high voltage may be induced across a primary winding of the ignition coil 1. The so-induced voltage is further increased by the ignition coil, resulting in a high voltage for ignition being induced across the secondary winding of the ignition coil 1.

Figure 2:
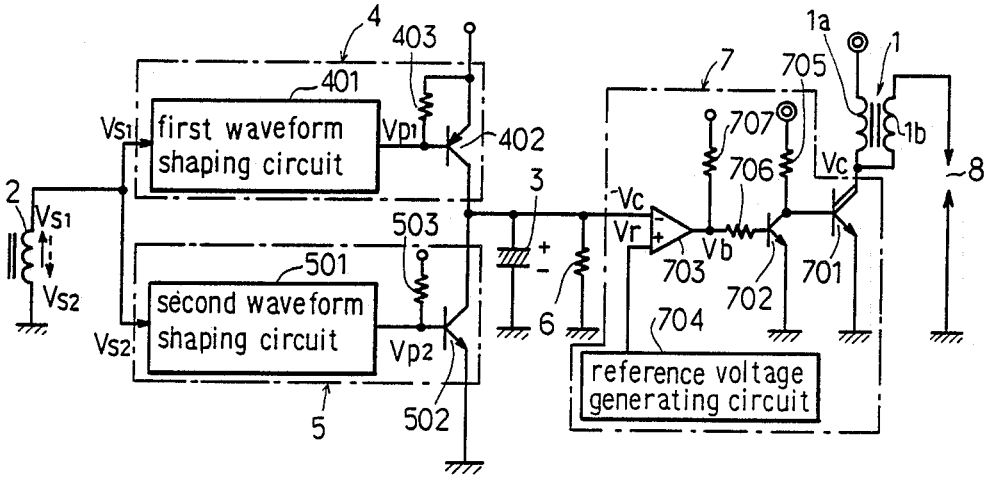
FIG. 2 is a circuit diagram showing an embodiment of an ignition system for an internal combustion engine according to the present invention.

FIG. 2 shows an embodiment of an ignition system for an internal combustion engine according to the present invention. An ignition system of the illustrated embodiment includes an ignition coil 1 having a primary winding 1*a* and a secondary winding 1*b*. One end of the primary and secondary windings 1*a* and 1*b* end commonly connected and between the other end of the secondary coil 1*b* and a ground is connected an ignition plug 8. The other end of the primary winding la is connected through a power switch (not shown) to a positive terminal of a battery of which a negative terminal is grounded.

The ignition system also includes a signal coil 2, which may comprise a pulser coil. The pulser coil 2 is arranged in a signal magneto mounted on an internal combustion engine. The pulser coil 2 generates a first signal $V_{s1}$ of a positive polarity and a second signal $V_{s2}$ of a negative polarity in synchronism with rotation of the engine, as shown in FIG. 3(A) first signal $V_{s1}$ exceeds a threshold level the advanced position or at a position of which a phase is advanced relative to an ignition position of the engine and the second signal $V_{s2}$ exceeds the threshold level Vt at the ignition position. The position of generation of each of the first signal $V_{s1}$ and the second signal $V_{s2}$ may be adjusted by suitably setting a length of the magnetic pole of the signal magneto along its periphery and a position of mounting of the pulser coil 2. For example, when an induction-type generator is used for the signal magneto, adjustment of the length of its inductor along a periphery thereof permits an angle from generation of the first signal or the position at which the first signal exceeds the threshold level to generation of the second signal or the position at which the second signal exceeds the threshold level. Adjustment of the position of mounting of the pulser coil 2 permits the timing of generation of the second signal to coincide with the ignition position.

The ignition system of the embodiment also includes a charging circuit 4, which, in the illustrated embodiment, comprises a first waveform shaping circuit 401, a transistor 402 and a resistor 403. As shown in FIG. 3(B), the first waveform shaping circuit 401 generates a first pulse signal $V_{p1}$ which falls to zero when the first signal $V_{s1}$ exceeds the threshold level Vt and rises when the first signal $V_{s1}$ falls below the threshold level Vt. The waveform shaping circuit 401 may be constituted by, for example, a transistor and a control circuit for controlling the transistor. In this instance, the control circuit may be constructed so as to cause the transistor to be turned on when the first signal $V_{s1}$ exceeds the threshold level Vt and turned off when it falls below the threshold level.

The transistor 402 comprises a PNP-type transistor, of which an emitter is connected through a key switch (not shown) to a positive output terminal of a D.C. power supply circuit including a power supply or battery. The base of the transistor 402 is connected to an output terminal of the first waveform shaping circuit 401, and the resistor 403 is connected between the emitter of the transistor 402 and its base. Between a collector of the transistor 402 and a ground is connected a control capacitor 3, and a discharge resistor 6 is connected across the control capacitor.

A discharge circuit 5 is arranged which comprises a second waveform shaping circuit 501, a transistor 502 and a resistor 503. The second waveform shaping circuit 501, as shown in FIG. 3(C), generates a second pulse signal $V_{p2}$ which rises when the second signal $V_{s2}$ exceeds the threshold level Vt and falls when it drops below the threshold level Vt. The second waveform shaping circuit 501 may comprise, for example, a circuit which turns on the transistor when the second signal $V_{s2}$ falls below the threshold level Vt and turns off it when the second signal exceeds the threshold level Vt.

The transistor 502 comprises an NPN-type transistor of which an emitter is grounded. Its base is connected to an output terminal of the second waveform shaping circuit 501. Also, the base is connected through the resistor 503 and a key switch (not shown) to a positive output terminal of a D.C. power supply circuit, and a collector of the transistor 502 is connected to the non-ground side terminal of the control capacitor 3.

The ignition system of the illustrated embodiment further includes a primary current control switch circuit 7, which comprises a main transistor 701 comprising a plurality of NPN-type transistors subjected to Darlington connection, an NPN-type interruption control transistor 702, a comparison circuit 703, a reference voltage generating circuit 704, and resistors 706 and 707. The emitter of the main transistor 701 is grounded and its collector is commonly connected to the primary and secondary windings 1*a* and 1*b* of the ignition coil 1. Also, the base of the main transistor 701 is connected through a resistor 705 and a key switch (not shown) to a positive terminal of a battery and also connected to the collector of the primary current interruption control transistor 702, and the emitter of the transistor 702 is grounded. The base of the transistor 702 is connected through the resistor 706 to an output terminal of the comparison circuit 703, which is then connected through the resistor 707 to a D.C. power supply circuit (not shown). To a non-inverting input of the comparison circuit 703 is supplied a reference voltage Vr from the reference voltage generating circuit 704. The magnitude of the reference voltage Vr is set to be less than the voltage induced across the control capacitor 3 when the second signal $V_{s2}$ exceeds the threshold level Vt. The power supply terminal of the comparison circuit 703 is connected to a D.C. power supply (not shown).

The remaining part of the ignition system shown in FIG. 2 may be constructed in substantially the same manner as shown in FIG. 1.

Now, the manner of operation of the ignition system of FIG. 2 constructed as described above will be described hereinafter with reference to FIGS. 3(A) to 3(F).

In the circuit shown in FIG. 2, the voltage Vc across the control capacitor 3 falls below the reference voltage Vr, the potential at the output terminal of the comparison circuit 703 is kept at a high level, so that a base current is supplied through the resistors 707 and 706 to the interruption control transistor 702 to lead to turning-on of the transistor 702. At this time, the current to be supplied to the base of the main transistor 701 is substantially bypassed through the interruption control transistor 702 from the main transistor 701, to thereby keep the main transistor turned off.

When the first signal $V_{s1}$ exceeds the threshold level Vt at a time $t_1$, the output terminal of the first waveform shaping circuit 401 is kept at a ground potential while the first signal $V_{s1}$ is being kept above the threshold level. The base of the transistor 402 is kept at a ground potential while the first pulse signal $V_{p1}$ is being kept at zero. Accordingly, a current flows through the base of the transistor 402 to render it turned on. This causes the control capacitor 3 to be charged at the polarity shown in FIG. 2, resulting in the control voltage Vc across the capacitor rising as shown in FIG. 3(D). Charges in the capacitor 3 are gradually discharged through the discharge resistor 6, therefore, the control voltage Vc is gradually decreased correspondingly. When the second signal $V_{s2}$ exceeds the threshold level at a time, which is an ignition position, the second pulse signal $V_{p2}$ rises as shown in FIG. 3(C). At this time, the transistor 502 is turned on to instantaneously carry out discharge of the capacitor 3. Accordingly, the control voltage Vc is instantaneously lowers to zero.

The control voltage Vc exceeds the reference voltage Vr as soon as it rises. Accordingly, a potential at the output terminal of the comparison circuit 703 is caused to be at a level of zero or at a ground potential level, resulting in the transistor 702 being turned off. This causes a base current to flow through the resistor 705 to the main transistor 701 to render the main transistor conductive, so that a primary current may flow from a battery of a D.C. power supply circuit through the primary winding 1*a* of the ignition coil 1 and the collector-emitter of the transistor 701. A voltage Vtb across the base of the transistor 701 and a voltage Vtc across its collector are as shown in FIGS. 3(E) and 3(F), respectively.

The control voltage Vc lowers below the reference voltage Vr as soon as it falls at the ignition position or time $t_2$, so that a potential at the output terminal of the comparison circuit 703 is increased to a degree sufficient to cause a base current to be supplied to the transistor 702. This leads to turning-on of the transistor 702 and turning-off of the transistor 701. Such turning-off of the transistor 701 leads to interruption of the primary current, so that a high voltage in a direction of causing flow of the primary current through the primary winding of the ignition coil to be continued may be induced across the primary winding 1*a* of the ignition coil 1. The high voltage is further increased to cause a high voltage for ignition to be induced across the secondary winding 1*b* of the ignition coil 1. The high voltage for ignition is applied to the ignition plug 8, so that the ignition plug 8 generates a spark, resulting in ignition of the internal combustion engine.

As can be seen from the foregoing, the ignition system of the illustrated embodiment permits the position at which the primary current starts to flow through the ignition coil to be determined by the position at which the first signal $V_{s1}$ is generated, so that a time $t_c$ during which the primary current flows may be determined without a specific complicated circuit. This results in effectively preventing an increase in power consumption and an increase in temperature of the ignition coil due to the flow of the primary current for an excessive period of time.

Supposing that, in FIGS. 3(A) to 3(F), the engine is stopped at the time $t_2$ prior to generation of the second signal $V_{s2}$ after the first signal $V_{s1}$ is generated at the time $t_1$, the transistor 502 is still kept turned off at the time $t_2$ because the second signal is not yet generated at this time. Accordingly, instantaneous discharge of the control capacitor 3 does not take place. However, the control capacitor 3 gradually carries out its discharge through the discharge resistor 6 at a predetermined time constant, so that the control voltage Vc is gradually decreased and falls below the reference voltage Vr at a time $t_4$. When the control voltage Vc thus falls below the reference voltage Vr at the time $t_4$, a potential at the output terminal of the comparison circuit is increased to a high level to lead to turning-on of the transistor 702. This causes the main transistor 701 to be turned off, which is thereafter kept turned off until the first signal is generated after a starting operation of the engine takes place. Thus, the illustrated embodiment effectively eliminates a disadvantage that the ignition coil is overheated due to continuing flow of the primary current after stop of the engine.

In the embodiment described with reference to FIG. 2, the transistor 702, functioning as a switching device for the primary current control switch, comprises a bipolar transistor 702 of a relatively low input impedance. Accordingly, the comparison circuit 703 is interposedly arranged between the control capacitor 3 and the transistor 702 to prevent discharge of the control capacitor 3 through the base circuit of the transistor 702. In this respect, use of a switching device of a high input impedance as a switch for carrying out on-off control of the primary current flowing through the ignition coil permits the control voltage Vc across the control capacitor 3 to directly control the switching device.

FIG. 4 shows another embodiment of an ignition system for an internal combustion engine according to the present invention, which is so constructed that a switch for carrying out on-off control of a primary current flowing through an ignition coil 1 may be directly controlled by a control voltage Vc across a control capacitor 3. For this purpose, in the embodiment of FIG. 4, a field effect transistor (FET) of a power-MOSFET type is used as a switching device 701' for constituting a primary current control switch circuit 7. A source of the FET 701' is grounded and its drain is connected to a connection point between a primary winding of the ignition coil 1 and its secondary winding. Also, in the embodiment, the control voltage Vc across the control capacitor 3 is applied directly to a gate-source of the FET 701'.

In such construction of the embodiment described above, the FET 701' is turned on to flow a primary current through the primary winding of the ignition coil 1 when the control voltage Vc exceeds a predetermined level; whereas the FET 701' is turned off to induce a high voltage across the secondary winding of the ignition coil when the control voltage Vc lowers below the level.

The remaining part of the embodiment shown in FIG. 4 may be constructed in substantially the same manner as that shown in FIG. 2.

In the embodiment of FIG. 4, an FET is used as the switch for carrying out on-off control of the primary current of the ignition coil. Likewise, in the embodiment of FIG. 2, an FET may be substituted for the transistor 702, and a bipolar transistor may be used as the switch for carrying out on-off control of the primary current of the ignition coil. In this instance, on-off control of the main transistor 701 may be carried out by directly controlling the FET by means of the voltage across the control voltage 3 without arranging a high input impedance circuit such as the comparison circuit.

In each of the embodiments described above, the first and second signals are converted into pulse signals by the waveform shaping circuits 401 and 402, respectively. Alternatively, the embodiments each may be so constructed that the first and second signals directly trigger the switching devices 402 and 502 of the charging circuit 4 and discharge circuit 5, respectively.

Also, in the embodiments, the first signal $V_{s1}$ and second signal $V_{s2}$ generated from the pulser coil 2 are a signal of a positive polarity and a signal of a negative polarity, respectively. However, the first and second signals may have a negative polarity and a positive polarity, respectively.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An ignition system for an internal combustion engine comprising:

at least one ignition coil;

a signal coil for generating a first signal at a position of which a phase is advanced relative to an ignition position of the internal combustion engine and a second signal at said ignition position;

a control capacitor;

a charging circuit for charging said control capacitor when said first signal is generated;

a discharge circuit for causing discharge of said control capacitor when said second signal is generated;

a discharge resistor connected in parallel with said control capacitor;

a switch circuit for controlling a primary current which is turned on to cause a primary current to flow from a power supply to said ignition coil when a voltage across said control capacitor rises and turned off to interrupt said primary current when said voltage falls.

2. An ignition system for an internal combustion as defined in claim 1, wherein said charging circuit comprises a waveform shaping circuit for generating a first pulse signal for a period of time during which said first signal exceeds a predetermined threshold level; and a charging switch circuit kept turned on to charge said control capacitor by means of a voltage from said power supply while said first pulse is being generated.

3. An ignition system for an internal combustion engine as defined in claim 1, wherein said discharge circuit comprises a waveform shaping circuit for generating a first pulse signal for a period of time during which said first signal exceeds a predetermined threshold level; and a discharge switch circuit driven by said second pulse signal to be turned on, to thereby instantaneously carry out discharge of said control capacitor.

4. An ignition system for an internal combustion engine as defined in claim 1, wherein said discharge resistor has a resistance value sufficient to effectively prevent discharge of said control capacitor until said second signal is generated while the internal combustion engine is being properly actuated.

5. An ignition system for an internal combustion engine as defined in claim 1, wherein said primary current control switch circuit comprises a reference voltage generating circuit;

a comparison circuit for carrying out comparison between a reference voltage from said reference voltage generating circuit and a voltage of said control capacitor; and a primary current control semiconductor switch element connected in series to a primary winding of said ignition coil and driven by a signal supplied from said comparison circuit.

6. An ignition system for an internal combustion engine as defined in claim 1, wherein said primary current control switch circuit comprises a semiconductor switch element of a large input impedance.

7. An ignition system for an internal combustion engine as defined in claim 5, wherein said semiconductor switch element is a field effect transistor.

8. An ignition system for an internal combustion engine comprising:

an ignition coil;

a pulser coil for generating a first signal at a position of which a phase is advanced relative to an ignition position of the internal combustion engine in synchronism with rotation of the internal combustion engine;

a control capacitor;

a charging circuit for charging said control capacitor when said first signal is generated;

a discharge circuit for causing discharge of said control capacitor when a second signal is generated;

a discharge resistor connected in parallel with said control capacitor;

a primary current control transistor switch circuit in which a voltage across said control capacitor is used as a control voltage and which is turned on to cause a primary current to flow from a power supply to said ignition coil when said control voltage rises and turned off to interrupt said primary current when said control voltage falls.

* * * * *